US006170728B1

(12) United States Patent
Zenczak et al.

(10) Patent No.: US 6,170,728 B1
(45) Date of Patent: Jan. 9, 2001

(54) DRIVE WHEELS FOR AN APPARATUS PERFORMING A WORK OPERATION ON STRIP MATERIAL

(75) Inventors: Brian Zenczak, Ellington; Kenneth Fisher, Vernon; Michael Thomas, Hartford; Richard Schlueter, Clinton, all of CT (US)

(73) Assignee: Gerber Scientific Products, Inc., Manchester, CT (US)

( * ) Notice: Under 35 U.S.C. 154(b), the term of this patent shall be extended for 0 days.

(21) Appl. No.: 09/273,951

(22) Filed: Mar. 22, 1999

(51) Int. Cl.[7] ..... B65H 20/02
(52) U.S. Cl. ..... 226/193; 92/31; 92/35
(58) Field of Search ..... 226/193, 181, 226/183; 492/34, 31, 30, 33, 35

(56) References Cited

U.S. PATENT DOCUMENTS

| | | | | |
|---|---|---|---|---|
| 211,566 | * | 1/1879 | Gwathney . | |
| 1,589,595 | * | 6/1926 | Hitchcock | 226/193 X |
| 2,338,635 | * | 1/1944 | Galber . | |
| 3,042,989 | * | 7/1962 | Foley | 226/193 X |
| 3,056,164 | * | 10/1962 | Reichel et al. | 226/193 X |
| 4,068,620 | * | 1/1978 | Peters . | |
| 4,384,298 | | 5/1983 | LaBarre et al. . | |
| 4,527,174 | * | 7/1985 | Fujiwara et al. | 226/181 X |
| 4,627,137 | * | 12/1986 | Wildt . | |
| 4,683,480 | | 7/1987 | Sakamoto et al. . | |
| 4,903,045 | | 2/1990 | Sakamoto et al. . | |
| 5,138,341 | * | 8/1992 | Kobayashi | 226/181 X |
| 5,179,986 | * | 1/1993 | Beuving et al. | 492/34 X |
| 5,445,588 | * | 8/1995 | Ishibashi et al. | 492/31 |
| 5,645,361 | | 7/1997 | Mitsushima et al. . | |

* cited by examiner

*Primary Examiner*—Donald P. Walsh
*Assistant Examiner*—Collin A. Webb
(74) *Attorney, Agent, or Firm*—McCormick, Paulding & Huber LLP

(57) ABSTRACT

An apparatus for performing a work operation on sheet material includes a plurality of drive wheels for driving the sheet material in cooperation with a plurality of pinch rollers along a feed path. Each of the drive wheels includes a drive surface having a plurality of primary teeth and a plurality of secondary teeth. Each primary tooth includes a top surface and a plurality of primary contact points to engage the sheet material. Each secondary tooth includes either a secondary contact line or a secondary contact point that come into contact with the sheet material to provide additional driving force and to prevent the sheet material from being perforated by the primary teeth. The primary teeth and the secondary teeth of the drive wheels engage the sheet material to advance the sheet material along the feed path. The drive surface of the drive wheels of the present invention minimizes slippage of the sheet material in the drive apparatus without damaging the sheet material.

24 Claims, 3 Drawing Sheets

DRIVE WHEELS FOR AN APPARATUS PERFORMING A WORK OPERATION ON STRIP MATERIAL

BACKGROUND OF THE INVENTION

1. Technical Field

The present invention relates to an apparatus for performing a work operation on a sheet material while driving the sheet material along a feed path and, more particularly, to a plurality of drive wheels that engage the sheet material for driving the sheet material along the feed path therein.

2. Background Art

Friction, grit, or grid drive systems for moving strips or webs of sheet material longitudinally back and forth along a feed path through a plotting, printing, or cutting device are well known in the art. In such drive systems, friction (or grit or grid) wheels are placed on one side of the strip of sheet material (generally vinyl or paper) and pinch rollers, of rubber or other flexible material, are placed on the other side of the strip, with spring pressure urging the pinch rollers and material against the friction wheels. During plotting, printing, or cutting, the sheet material is driven back and forth, in the longitudinal or X-direction, by the friction wheels, while, at the same time, a pen, printing head, or cutting blade is driven over the sheet material in the lateral or Y-direction.

These systems have gained substantial favor because of their ability to accept plain (unperforated) strips of material in differing widths. The drive wheels play a paramount role in moving the sheet material along the feed path. Each wheel is typically associated with a longitudinal edge of the sheet material and has a cylindrical shape with a plurality of teeth formed on the surface thereof. The teeth engage and drive the sheet material along the feed path. The tooth pattern of the drive wheels is embossed on the back of the sheet material as the sheet material is driven through the friction feed apparatus with the pinch rollers urging the sheet material against the drive wheels. Ideally, as the direction of feed of the sheet material is reversed in the friction drive apparatus during a work operation, the teeth fit into the embossed marks that were previously formed during the forward feed. The wheels must engage the sheet material to prevent any slippage of the sheet material because even relatively minor slippage can have a detrimental effect on the work operation being performed by the apparatus. Also, the drive wheels must engage the sheet material without causing visible damage to the sheet material. Additionally, the teeth must not be brittle to avoid breakage and wear during the work operation.

One existing type of friction wheel is fabricated by first, chemically etching a tooth pattern on a flat sheet of material. Then, the etched material is cut into strips and the strips are helically wrapped around a donor hub and welded at the seams to form a cylindrical shape. Subsequently, a special coating is applied. The cylinder is then removed from the donor hub and fitted onto a finished hub to form a grit wheel. First, the fabrication process for this type of a friction wheel is time consuming and expensive. Second, the process does not yield consistent results. Since the friction wheels for each apparatus have to be well matched, a subsequent inspection process is required. Therefore, this type of friction wheel is not very desirable.

Another type of friction wheel used in the industry has a cylindrical shape with a gritty circumferential surface and a random pattern. The gritty surface is formed by mechanically bonding tiny solid particles, such as diamond dust or chips. However, in this process it is difficult to ensure that the outside and drive diameters of one friction wheel are substantially identical to the outside and drive diameters of another friction wheel. The drive diameter of the friction wheel is critical because it determines how much the sheet material advances in the longitudinal direction. If two wheels have different drive diameters, one side of the sheet material will be driven greater distance in the longitudinal direction than the other side of the sheet material. Thus, the sheet material will potentially skew in the apparatus and result in damaged graphic image. This becomes especially problematic for longer graphic images and higher speed apparatus, wherein even a small difference in the drive diameter of the wheels results in large errors.

Yet another type of a friction wheel that is used in the industry has a knurled surface. The knurled surface is formed by displacing material to form an irregular pattern. The knurling process also does not yield substantially identical friction wheels.

A U.S. Pat. No. 4,903,045 entitled "X-Y Plotter For Non-Perforated Paper" to Sakamoto et al. discloses a drive roller with a cylindrical reference surface having a plurality of projections of sharp quadrangular pyramidal shape distributed over a reference surface. The sharp projections perforate the paper as the paper is driven through the plotter. The reference surface radially supports the non-thrusted portions of the paper and drives the paper by the friction force. The disclosed drive wheels have several deficiencies and drawbacks. First, the sharp projections perforate the paper and damage the graphic image. These drive wheels are not suitable for wider paper that requires additional wheels in the middle of the plot. Additionally, the sharp projections over time become dull and therefore cause reduction in driving force.

Another U.S. Pat. No. 4,683,480 entitled "X-Y Plotter Drive Roller Arrangement" to Sakamoto et al. also discloses a drive roller with a plurality of sharp projections that perforate the paper. The sharp projections are disposed substantially adjacent to each other thereby not providing sufficient driving force and allowing slippage of the sheet material.

Therefore, it is desirable to provide a drive roller that meets requirements and overcomes the deficiencies described above.

SUMMARY OF THE INVENTION

It is an object of the present invention to provide drive wheels for a friction drive apparatus that advance sheet material therethrough without allowing slippage.

It is another object of the present invention to provide drive wheels for a friction drive apparatus that do not damage the graphic image formed on the sheet material.

According to the present invention, a drive wheel for advancing sheet material along a feed path in an apparatus performing a work operation on the sheet material includes a substantially cylindrical body with a circumferential drive surface having a plurality of primary teeth and a plurality of secondary teeth for engaging the sheet material. The plurality of primary teeth and the plurality of secondary teeth form an alternating pattern and form pluralities of first and second base lines. Each of the plurality of primary teeth includes a substantially flat top surface and a plurality of primary contact points. Each of the plurality of secondary teeth includes either a secondary contact point or a secondary contact line. As the drive wheel rotates about an axis of rotation, the primary contact points initially come into contact with the sheet material, embossing the sheet material and driving it in a feed direction. The secondary contact points and lines provide an additional driving force to the sheet material, thereby minimizing slippage of the sheet material fed through the apparatus.

One advantage of the drive wheels of the present invention is that they can be placed in the middle portion of wider sheet material without damaging the sheet material and the graphic image.

Another advantage of the drive wheels of the present invention is that various types of sheet material can be accommodated, including thin paper and thicker vinyl sheet material, without damaging either type.

A further advantage of the present invention is that the contour of the drive surface of the drive wheels minimizes the breakage and wear thereof.

The foregoing and other advantages of the present invention become more apparent in light of the following detailed description of the exemplary embodiments thereof, as illustrated in the accompanying drawings.

DETAILED DESCRIPTION OF THE INVENTION

Figure 1:
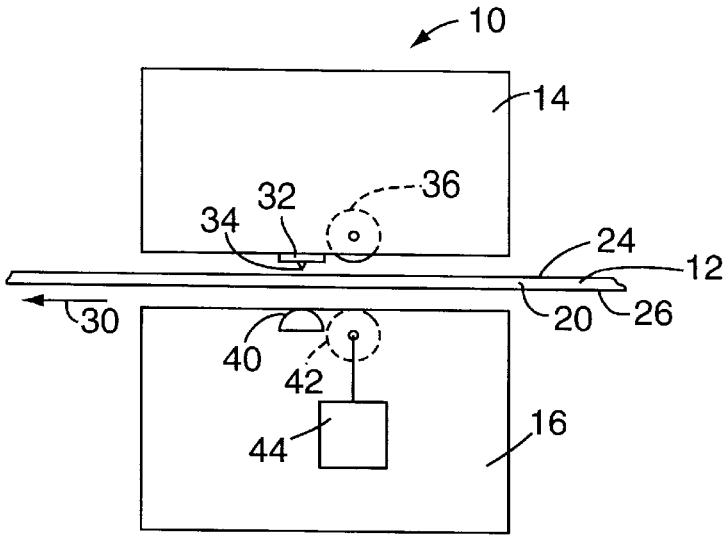
FIG. 1 is an exploded side elevational view schematically showing a friction drive apparatus with a sheet material driven along a feed path.
Figure 2:
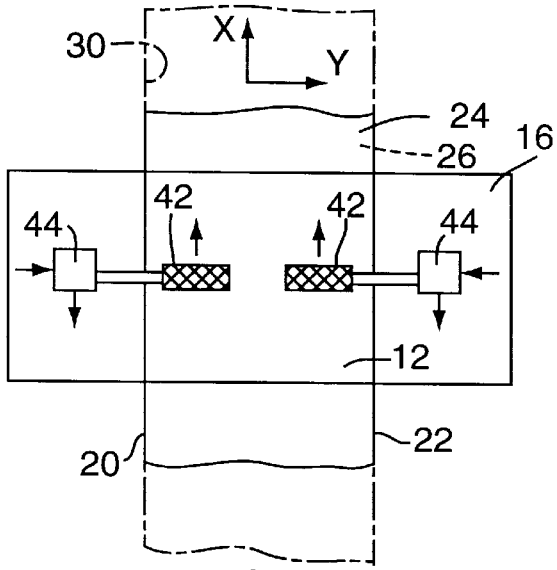
FIG. 2 is a top plan view of a bottom portion of the friction drive apparatus of FIG. 1 with a plurality of drive wheels advancing the sheet material along the feed path, shown in phantom.

Referring to FIG. 1, an apparatus 10 for performing a work operation on sheet material 12 includes a top portion 14 and a bottom portion 16. The sheet material 12 with first and second longitudinal edges 20, 22 and first and second sides 24, 26 is fed in a longitudinal or X-axis direction along a feed path 30, as best seen in FIG. 2. The top portion 14 includes a tool head 32 supporting a tool 34, as shown in FIG. 1. The tool head 32 is movable within the top portion 14 in a lateral or Y-axis direction. The top portion 14 also includes a plurality of pinch rollers 36 rotatably supported therein.

The bottom portion 16 of the apparatus 10 includes a sheet support 40 disposed in register with the tool 34, and a plurality of drive wheels 42 disposed in register with the pinch rollers 36. The drive wheels 42 are driven by a motor 44 connected thereto.

Figure 3:
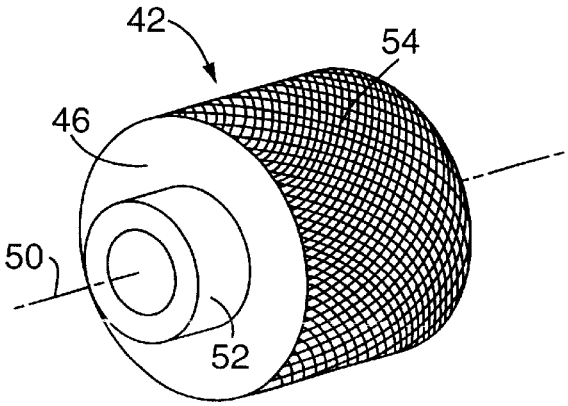
FIG. 3 is an enlarged, perspective view of the drive wheel of the friction drive apparatus of FIG. 2, according to the present invention.

Referring to FIG. 3, each drive wheel 42 has a cylindrical body 46, rotatable about a central axis 50, and a mounting portion 52 to facilitate mounting of the wheel 42 onto a motor shaft (not shown). Each drive wheel 42 also includes a substantially circumferential drive surface 54 formed on the circumference of the cylindrical body 46.

Figure 4:
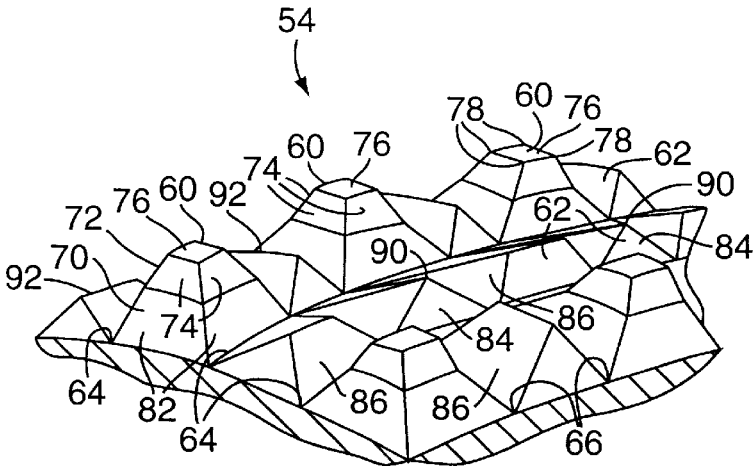
FIG. 4 is an enlarged, perspective view of a circumferential drive surface of the drive wheel of FIG. 3.
Figure 5:
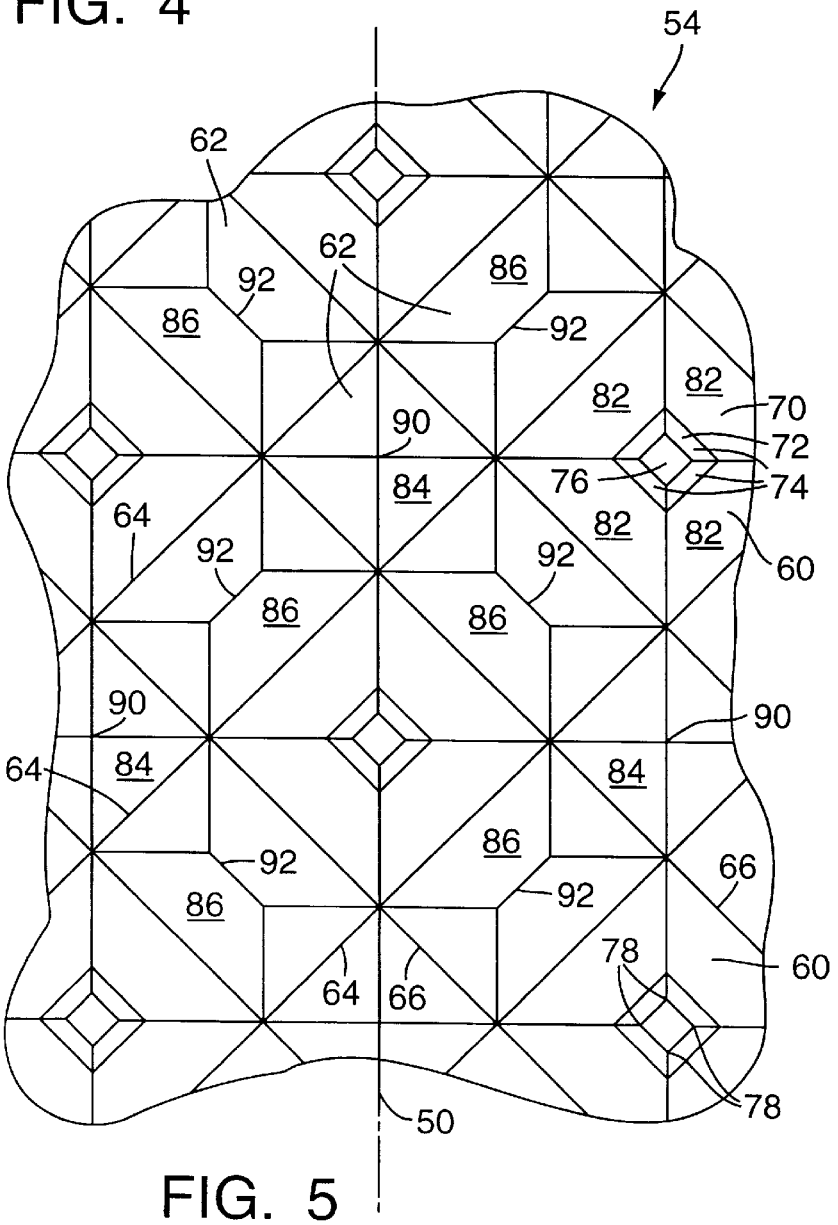
FIG. 5 is an enlarged, top view of the circumferential drive surface of FIG. 4.

Referring to FIG. 4, the drive surface 54 includes a plurality of primary teeth 60 and a plurality of secondary teeth 62 forming an alternating pattern with the plurality of primary teeth 60 and also forming a first plurality of base lines 64 and a second plurality of base lines 66 therebetween, as also seen in FIG. 5. Each primary tooth 60 includes a base portion 70 and a top portion 72 formed integrally therewith. The top portion 72 includes a plurality of top sides 74 and a top surface 76 with a plurality of primary tooth contact points 78. The base portion 70 of each primary tooth 60 includes base sides 82 and has a base portion height. Each top portion 72 of each primary tooth 60 has a top portion height that in combination with the base portion height defines a primary tooth height.

The plurality of secondary teeth 62 includes a plurality of contact point secondary teeth 84 and a plurality of contact line secondary teeth 86, as best seen in FIGS. 4 and 5. Each contact point secondary tooth 84 has a substantially pyramidal shape with a secondary contact point 90 formed atop thereof. Each contact line secondary tooth 86 includes a substantially pyramidal shape forming a secondary contact line 92 atop thereof. The secondary teeth 62 have a secondary teeth height that is substantially smaller than the primary teeth height.

In the preferred embodiment, the plurality of first base lines 64 is substantially orthogonal to the second plurality of base lines 66 with the first and second plurality of base lines 64, 66 each forming a substantially 45° angle with the central axis 50 of the drive wheel 42.

In operation, as the sheet material 12 is fed along the feed path 30 in the longitudinal or X-axis direction, the drive wheels 42 and the pinch rollers 36 are urged together and engage the sheet material 12, as best seen in FIGS. 1 and 2. A single motor 44 or a plurality of motors 44 rotates the drive wheels 42 at substantially the same speed to ensure that both longitudinal edges 20, 22 of the sheet material 12 progress along the feed path 30 in the X-axis direction substantially simultaneously. As the sheet material 12 moves in the longitudinal or X-axis direction, the tool head 32 moves in a lateral or Y-axis direction, either plotting, printing or cutting the sheet material 12 depending on the specific type of tool 34 employed.

Figure 6:
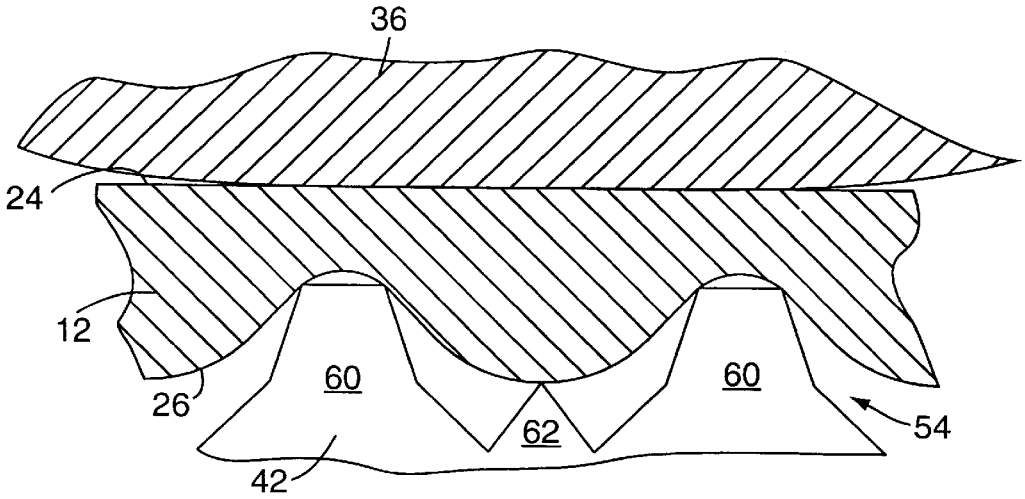
FIG. 6 is a cross-sectional, partial view of the circumferential drive surface of FIG. 4 with the sheet material pressed against the drive surface with a pinch roller.

Referring to FIG. 6, as the pinch rollers 36 are urged against the drive wheels 42, the sheet material 12 is pressed against the drive surface 54. The second side 26 of the sheet material 12 conforms substantially to the shape of the drive surface 54 of the drive wheel 42. The primary teeth 60 drive the sheet material 12 by embossing a pattern on the second side 26 thereof and continually advancing the sheet material 12 in the feed direction 30. The secondary teeth 62 also drive the sheet material 12. The secondary points of contact 90 and the secondary lines of contact 92 of the secondary teeth 62 also come into contact with the sheet material 12, as the sheet material 12 is pressed onto the drive surface 54 of the drive wheels 42 by the pinch rollers 36. The secondary points and lines of contact 90, 92 engage the sheet material 12 and provide additional driving force thereto. Thus, the drive wheels 42 according to the present invention, minimize slippage of the sheet material 12 in the apparatus 10 by having a plurality of primary teeth 60 providing driving force to advance the sheet material 12 along the feed path 30 and also having a plurality of secondary teeth 62 providing additional driving force to advance the sheet material 12. This feature of the present invention is a major benefit over the prior art, since the additional driving force is more effective in further minimizing slippage of the sheet material 12 than mere friction force between primary teeth.

Figure 7:
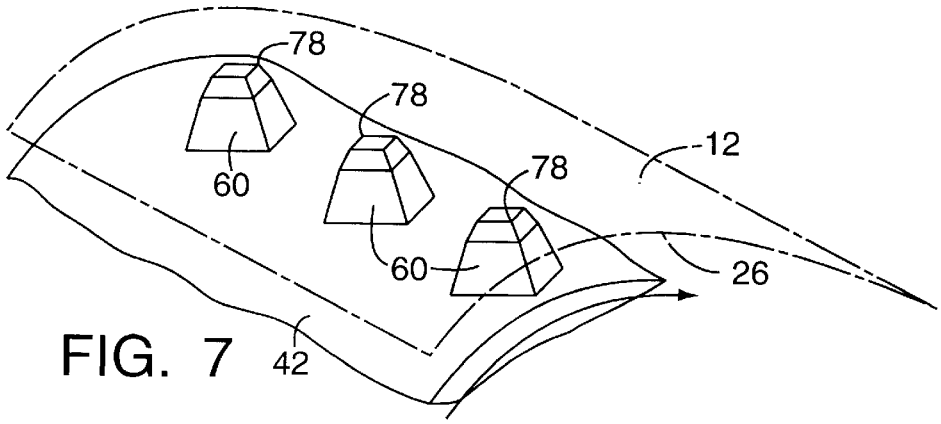
FIG. 7 is a schematic representation of a plurality of primary teeth with the sheet material driven over it.

Referring to FIG. 7, since the primary teeth 60 are positioned at a substantially 45° (forty five degree) angle with respect to the axis of rotation 50 of the drive wheel 42, as the drive wheel 42 is rotated, each primary tooth 60 initially contacts the second side 26 of the sheet material 12 with one of the primary points of contact 78. This feature of the present invention ensures that the primary teeth 60 emboss the heavier and stiffer sheet material as well as the thinner sheet material. Since the pressure at the primary point of contact 78 is relatively greater than the pressure along a line of contact with the same applied force, the primary points of contact 78 emboss even heavy and stiff sheet material 12.

Additionally, since in the preferred embodiment of the present invention the top surface 76 of the primary teeth 60 is substantially flat rather than sharp, the sheet material 12 is embossed without being perforated. The secondary teeth 62 not only provide additional driving force, but also provide resistance to prevent puncture of the sheet material 12. Therefore, the drive wheels 42 of the present invention can be used with sheet material of various thicknesses without damaging or perforating the thinner sheet material.

Another advantage of the present invention is that the drive wheels 42 do not need to be placed only along the edges 20, 22 of the sheet material 12, since the drive wheels 42 do not have sharp teeth that damage the sheet material 12. Therefore, the drive wheels 42 can be used with wide sheet material 12 that requires placement of additional drive wheels 42 in the middle or central portion thereof.

A further advantage of the present invention is that breakage and wear of the teeth 60 is minimized because the base portion 70 of each primary tooth 60 is wider than the top portion 72 and also because the primary teeth 60 do not include a sharp tip.

The optimum size and shape of the teeth 60, 62 of the drive wheels 42 is governed by the drive wheel diameter, the pinch roller pressure and the pinch roller hardness. In the preferred embodiment of the present invention, the pitch of the primary teeth 60 or distance between them can vary approximately between 0.015" and 0.030" (fifteen thousandth of an inch to thirty thousandth inch). In the preferred embodiment, the pitch is approximately 0.020" (twenty thousandth of an inch). Each top surface 76 of the primary tooth 60 in the preferred embodiment of the present invention is approximately 0.002" by 0.002" (two thousandths by two thousandths of an inch) square. But each of those dimensions can vary approximately between 0.001" and 0.004" (one thousandth to four thousandths of an inch). The distance between the top surface 76 of the primary teeth 60 and the tips 90, 92 of the secondary teeth 62 in the preferred embodiment of the present invention is approximately 0.003" (three thousandths of an inch), but can range approximately between 0.002" and 0.006" (two thousandths to six thousandths of an inch). The secondary tooth 62 height in the preferred embodiment is approximately 0.003" (three thousandths of an inch), but can vary approximately between 0.001" and 0.006" (one thousandths to six thousandths of an inch). In the preferred embodiment of the present invention, the outside angle formed between the top surface 76 and top sides 74 of the primary teeth 60 is approximately 70° (seventy degrees), but can vary between 50° and 80° (fifty and eighty degrees) to ensure tooth sharpness, yet remain sufficiently strong and stiff. In the preferred embodiment of the present invention, the outside angle between the top surface 76 and base sides 82 is either substantially equal or less than the outside angle between the top surface 76 and top sides 74. In the preferred embodiment of the present invention, the outside angle between the top surface 76 and base sides 82 approximately equals 45° (forty five degrees).

In the preferred embodiment of the present invention, the drive wheels 42 are fabricated from tool steel and coated with Titanium Nitride (TiN). The drive surface 54 is formed by machining a plurality of contoured parallel grooves at a substantially 45° (forty five degree) angle to the axis of rotation 50 thereby forming the first plurality of base lines 64. Then, a second plurality of contoured parallel grooves is machined that are substantially orthogonal to the first plurality of grooves, hereby forming the second plurality of base lines 66 and also forming the primary and secondary teeth 60, 62. This manufacturing process ensures that all friction wheels have substantially identical drive diameters. Other methods of manufacture are possible and, the drive wheels 42 can be manufactured from other types of metals with various other coating applied thereto. Other potential coatings are Titanium Carbonitride (TiCN), Chromium Nitride (CrN), Titanium Aluminum Nitride (TiAlN), or Tungsten Carbide/Carbon (WC/C).

While the present invention has been illustrated and described with respect to a particular embodiment thereof, it should be appreciated by those of ordinary skill in the art, that various modifications to this invention may be made without departing from the spirit and scope of the present invention.

We claim:

1. A drive wheel for driving sheet material along a feed path in an apparatus performing a work operation on said sheet material, said drive wheel comprising:

a body having a substantially cylindrical shape rotating about a central axis and having a circumferential drive surface, said drive surface having a plurality of primary teeth aid a plurality of secondary teeth formed thereon in an alternating pattern for engaging said sheet material, said plurality of primary teeth differs in height and shape from said plurality of secondary teeth each of said plurality of primary teeth having a blunt feature and each of said plurality of secondary teeth having a sharp feature with said secondary teeth being substantially shorter than said primary teeth.

2. The drive wheel according to claim 1 wherein each said primary tooth has a primary tooth height and each said secondary tooth has a secondary tooth height with said primary tooth height being greater than said secondary tooth height.

3. The drive wheel according to claim 1 wherein said primary teeth provide primary driving force to said sheet material and said secondary teeth provide secondary driving force to said sheet material.

4. The drive wheel according to claim 1 wherein each of said plurality of primary teeth includes a top portion and a base portion, said top portion having a top surface for engaging said sheet material.

5. The drive wheel according to claim 4 wherein said top surface of each of said plurality of primary teeth is substantially flat.

6. The drive wheel according to claim 4 wherein said top surface of each of said plurality of primary teeth includes a plurality of primary contact points that initially engage said sheet material.

7. The drive wheel according to claim 1 wherein each of said plurality of primary teeth is substantially equally spaced away from another of said plurality of primary teeth.

8. The drive wheel according to claim 1 wherein each of said plurality of drive wheels includes a plurality of base lines formed between said plurality of primary teeth and said plurality of secondary teeth, said base lines traversing each of said plurality of drive wheels at a predetermined angle with respect to an, axis of rotation of each of said plurality of drive wheels.

9. The drive wheel according to claim 8 wherein said predetermined angle is a substantially 45° angle.

10. An apparatus for performing a work operation on a sheet material while driving said sheet material in a longitudinal direction along a feed path, said sheet material having a first and second longitudinal edges, said sheet material having a first side and a second side, said apparatus comprising:

a plurality of pinch rollers associated with said first side of said sheet material; and a plurality of drive wheels associated with said second side of said sheet material, each of said plurality of drive wheels having a drive surface, said drive surface including a plurality of primary teeth and a plurality of secondary teeth formed in an alternating pattern with said plurality of primary teeth, said plurality of primary teeth differs in height a nd shape from said plurality of secondary teeth, each of said plurality of primary teeth having a blunt feature and each of said plurality of secondary teeth having a sharp feature with said secondary teeth being substantially shorter than said primary teeth, said plurality of primary teeth and said plurality of secondary teeth of each of said plurality of drive wheels in cooperation with said plurality of pinch rollers engaging said sheet material to drive said sheet material along said feed path.

11. The apparatus according to claim 10 wherein each of said plurality of primary teeth includes a top portion and a base portion, said top portion having a top surface for engaging said sheet material.

12. The apparatus according to claim 11 wherein said top surface of each of said plurality of primary teeth is substantially flat.

13. The apparatus according to claim 11 wherein said top surface of each of said plurality of primary teeth includes a plurality of primary contact points that initially engage said sheet material.

14. The apparatus according to claim 10 wherein each of said plurality of primary teeth is substantially equally spaced away from another of said plurality of primary teeth.

15. The apparatus according to claim 10 wherein each of said plurality of drive wheels includes a plurality of base lines formed between said plurality of primary teeth and said plurality of secondary teeth, said base lines traversing each of said plurality of drive wheels at a predetermined angle with respect to an axis of rotation of each of said plurality of drive wheels.

16. The apparatus according to claim 15 wherein said predetermined angle is a substantially 45° angle.

17. An apparatus for performing a work operation on a sheet material while driving said sheet material in a longitudinal direction along a feed path, said sheet material having a first side and a second side, said apparatus comprising:

a plurality of pinch rollers associated with said first side of said sheet material; and a plurality of drive wheels associated with said second side of said sheet material, each of said plurality of drive wheels having a drive surface, said drive surface including a plurality of primary teeth and a plurality of secondary teeth formed in an alternating pattern with said plurality of primary teeth, said plurality of primary teeth and said plurality of secondary teeth of each of said plurality of drive wheels in cooperation with said plurality of pinch rollers engaging said sheet material to drive said sheet material along said feed path, wherein said plurality of secondary teeth includes a plurality of contact point secondary teeth and a plurality of contact line secondary teeth.

18. The apparatus according to claim 7 wherein each of said plurality of contact point secondary teeth includes a contact point formed atop thereof for engaging said sheet material.

19. The apparatus according to claim 17 wherein each of said plurality of contact line secondary teeth includes a contact line formed atop thereof for engaging said sheet material.

20. A drive wheel for driving sheet material along a feed path in an apparatus performing a work operation on said sheet material, said drive wheel comprising:

a body having a substantially cylindrical shape rotating about a central axis and having a circumferential drive surface, said drive surface having a plurality of primary teeth and a plurality of secondary teeth formed thereon in an alternating pattern for engaging said sheet material, wherein said plurality of secondary teeth includes a plurality of contact point secondary teeth and a plurality of contact line secondary teeth.

21. The drive wheel according to claim 20 wherein each of said plurality of contact point secondary teeth includes a contact point formed atop thereof for engaging said sheet material.

22. The drive wheel according to claim 20 wherein each of said plurality of contact line secondary teeth includes a contact line formed atop thereof for engaging said sheet material.

23. An apparatus for performing a work operation on a sheet material while driving said sheet material in a longitudinal direction along a feed path, said sheet material having a first side and a second side, said apparatus comprising:

a plurality of pinch rollers associated with said first side of said sheet material; and a plurality of drive wheels associated with said second side of said sheet material, each of said plurality of drive wheels having a drive surface, said drive surface including a plurality of primary teeth and a plurality of secondary teeth formed in an alternating pattern with said plurality of primary teeth, each of said plurality of primary teeth including a blunt primary contact surface, each of said plurality of secondary teeth including a sharp secondary contact surface, said primary surfaces of said plurality of primary teeth and said secondary surfaces of said plurality of secondary teeth of each of said plurality of drive wheels in cooperation with said plurality of pinch rollers engaging said sheet material to drive said sheet material along said feed path with said primary teeth providing primary driving force and said secondary teeth providing secondary driving force.

24. The apparatus according to claim 23 wherein said primary teeth emboss said sheet material and said secondary teeth provide additional driving force thereto.

* * * * *

UNITED STATES PATENT AND TRADEMARK OFFICE

CERTIFICATE OF CORRECTION

PATENT NO. : 6,170,728 B1
DATED : January 9, 2001
INVENTOR(S) : Brian Zenczak et al.

It is certified that error appears in the above-identified patent and that said Letters Patent is hereby corrected as shown below:

Column 6, claim 1,
Line 38, delete "aid" and insert -- and --;

Column 8, claim 18,
Line 12, delete "claim 7" and insert -- claim 17 --.

Signed and Sealed this

Fifteenth Day of January, 2002

*Attest:*

*Attesting Officer*

JAMES E. ROGAN
*Director of the United States Patent and Trademark Office*